US007343852B2

(12) United States Patent
Olds

(10) Patent No.: US 7,343,852 B2
(45) Date of Patent: Mar. 18, 2008

(54) LOOSE MEDIA COMPACTING APPARATUS INCLUDING A CHARGING CHAMBER WITH RETRACTABLE WALLS

(76) Inventor: Emory L. Olds, 110 Timberland Dr., Cordele, GA (US) 31015

( * ) Notice: Subject to any disclaimer, the term of this patent is extended or adjusted under 35 U.S.C. 154(b) by 0 days.

(21) Appl. No.: 11/197,633

(22) Filed: Aug. 4, 2005

(65) Prior Publication Data

US 2007/0028787 A1 Feb. 8, 2007

(51) Int. Cl.
*B30B 9/03* (2006.01)

(52) U.S. Cl. ..... 100/190; 100/98 R; 100/215; 100/232; 100/233; 100/255

(58) Field of Classification Search ..... 100/40, 100/41, 42, 185, 186, 187, 188 R, 189, 190, 100/94, 95, 96, 97, 98 R, 218, 232, 233, 100/237, 215, 244, 240, 264, 295; 241/245, 241/266

See application file for complete search history.

(56) References Cited

U.S. PATENT DOCUMENTS 4,018,169 A * 4/1977 Schmalz ..... 100/39
4,594,942 A * 6/1986 Denneboom ..... 100/137
4,651,610 A * 3/1987 Schwelling ..... 83/636
4,658,719 A 4/1987 Jackson et al.
5,193,454 A * 3/1993 Bollegraaf ..... 100/142
5,832,815 A * 11/1998 Bollegraaf ..... 100/42
5,845,568 A * 12/1998 Rosser, Jr. ..... 100/190
6,694,871 B1 * 2/2004 Wildes et al. ..... 100/190
6,823,776 B1 * 11/2004 Olds ..... 100/41

* cited by examiner

*Primary Examiner*—Jimmy T. Nguyen
(74) *Attorney, Agent, or Firm*—Hugh D. Jaeger, Esq.

(57) ABSTRACT

A loose media compacting apparatus including a charging chamber with retractable walls where variable geometry components including pivotable opposed front and rear retractable charging chamber walls of a closed and compact charging chamber are retractably and expandingly positioned to present a large capacity open and expanded charging chamber having a volume sufficiently exceeding the capacity of the charging chamber in the closed and compact position. Upon accommodation of loose media by the expanded geometry of the open and expanded charging chamber, the front and rear retractable charging chamber walls are forcibly repositioned, whereby loose media is compressed in the reconfigured closed and compact charging chamber to form precompressed media which can subsequently be further compressed by an onboard ram or other compression devices.

26 Claims, 16 Drawing Sheets

LOOSE MEDIA COMPACTING APPARATUS INCLUDING A CHARGING CHAMBER WITH RETRACTABLE WALLS

CROSS REFERENCES TO RELATED APPLICATIONS

None.

BACKGROUND OF THE INVENTION

1. Field of the Invention

The present invention is for a loose media compacting apparatus which can be used with a baler or other equipment, and, more particularly, is for a loose media compacting apparatus including a charging chamber with opposed retractable walls.

2. Description of the Prior Art

Prior art charging chambers forming parts of loose media compacting apparatus for use with balers or other equipment have often been connected to loading hoppers having flared sides to accommodate wide conveyors delivering waste media. Such flared side geometry limits and hampers the delivery of waste media to the charging chamber. The flare or slope in the loading hopper creates a funnel effect between the loading hopper and the charging chamber which invites bulky media to inconveniently jam or bridge as it is gravity fed from the loading hopper to the charging chamber. Also, in prior art devices minimal attention has been devoted to centering waste media entering the charging chamber and to equal distribution of waste media entering the charging chamber, such inattention in turn adversely affecting waste media entering a downstream compression chamber. Specifically, the compression path of the main compression ram would get slightly out of alignment with surrounding and adjacent guide surfaces with the result that one side of the main compression ram met uneven resistive force to unevenly align with a guide structure and thereby cause undue and uneven wear of the contact surfaces. Such uneven loading also manifested itself in producing bales of uneven composition, whereby the bales would tend to banana or curve in single-ram balers, or have voids or varying densities in the case of two-ram or side-eject balers.

SUMMARY OF THE INVENTION

The general purpose of the present invention is to provide a loose media compacting apparatus including a charging chamber with retractable walls and process of operating same.

According to the present invention, there is provided a loose media compacting apparatus including a charging chamber with retractable walls including components mounted to or aligned along and about or associated with a framework having major structures including, but not limited to, a hydraulic power center, a main hydraulic actuating cylinder, a compression ram connected to and positionable by the main hydraulic actuating cylinder along a lower guide plate of substantial strength, a charging chamber having variable geometry, a loading chamber having straight and vertically aligned walls aligned to the top of the charging chamber having variable geometry, the variable geometry charging chamber including actuatable and forcibly pivotable opposed rear and front retractable charging chamber walls, each retractable charging chamber wall having a side plate intersecting a top plate, an arcuate top cover plate, and a serrated knife at the inner edge of the top plate. A representative compression chamber may be located adjacent to the charging chamber and may comprise a portion of the lower guide plate, a horizontally oriented top wall, and vertically oriented side walls. Loose media which is to be processed is delivered to the loading chamber to descend to rest upon the arcuate top cover plates of the closed opposed rear and front retractable charging chamber walls forming a closed and compact charging chamber and then loaded therefrom into a wide opening presented by the subsequently retracted opposed front and rear retractable charging chamber walls which then form an open and expanded charging chamber. Upon receiving loose media, the opposed front and rear retractable charging chamber walls are forcibly reactuated to a closed and compact original position to precompress the media, at which time serrated knives at the upper region of the retractable charging chamber walls grasp or cut excess media overlying the repositioned front and rear retractable charging chamber walls. During such precompression, the opposed retractable charging chamber walls exert substantially equal force to and about the media being precompressed to centrally locate and form precompressed media as a mass in centered alignment along the lower guide plate about the longitudinal centerline of the lower guide plate and thus along the longitudinal centerline of the charging chamber and the representative compression chamber. Together, the inwardly positioned front and rear retractable charging chamber walls and the lower guide plate form a closed charging chamber suitable for precompression of media. The main compression ram is then forcibly positioned against the precompressed media to force the precompressed media from the charging chamber into the representative compression chamber and possibly further for subsequent processing by an aligned baler external to the apparatus constituting the invention. Further, cutting of excess centrally located media also occurs at this time by shear knives and/or the serrated knives.

One significant aspect and feature of the present invention is a charging chamber with pivotable opposed front and rear retractable charging chamber walls wherein the opposed front and rear retractable charging chamber walls are forcibly positioned to a closed and compact position along and about a lower guide plate to form a charging chamber which is closed and compact and suitable for precharging ram operations and which when retracted to the open and horizontally expanded position provides a media receiving region of expanded volume, such volume exceeding that of the charging chamber in the compact state.

Another significant aspect and feature of the present invention is the formation of a cover or barrier for the charging chamber by the arcuate top cover plate structure of the opposed front and rear retractable charging chamber walls in the closed and compact position which separates incoming loose media in the loading chamber from the closed and compact charging chamber.

Still another significant aspect and feature of the present invention is the positioning and use of serrated knives at the inner ends of the front and rear retractable charging chamber walls to enable cutting of loose media at the upper and central region of the charging chamber during forcible positioning of the front and rear retractable charging chamber walls to the closed and compact position to facilitate retractable charging chamber wall closing.

Still another significant aspect and feature of the present invention is the positioning and use of serrated knives at the inner ends of the front and rear retractable charging chamber walls to enable media cutting and tearing at the upper and central region of the charging chamber during urging of the precompressed media from the closed and compact charging chamber to the representative compression chamber, thereby cutting and tearing the media where such media is separated and contained in either the loading chamber or the charging chamber.

Yet another significant aspect and feature of the present invention is the use of a non-restricting straight wall loading chamber to prevent media clogging.

Having thus briefly outlined the present invention and mentioned some significant aspects and features thereof, it is the principal object of the present invention to provide a loose media compacting apparatus including a charging chamber with retractable walls and process of operating same.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 5 is a cross section view along general section line A-A of FIG. 1, where the rear retractable charging chamber wall is positioned to the closed and compact position illustrating the general shape of the charging chamber in the closed and compact position;

FIG. 6 is a cross section view along general section line B-B of FIG. 1, where the rear retractable charging chamber wall and the front retractable charging chamber wall are positioned to the closed and compact position illustrating the general shape of the charging chamber in the closed and compact position;

FIG. 7 is a cross section view along line B-B of FIG. 1 illustrating the initial step in the use of the invention where the front and rear retractable charging chamber walls are hydraulically positioned to form a closed and compact charging chamber to receive loose media;

FIG. 8 is a cross section view along general section line A-A of FIG. 1 illustrating the initial step in the use of the invention where the front and rear retractable charging chamber walls are hydraulically positioned to form a closed and compact charging chamber to receive loose media;

FIG. 9 is a cross section view along general section line B-B of FIG. 1 illustrating a subsequent step in the use of the invention where the front and rear retractable charging chamber walls are hydraulically retracted and repositioned to present an open and expanded charging chamber suitable for acceptance and accommodation of large amounts of loose media;

FIG. 10 is a cross section view along general section line A-A of FIG. 1 illustrating a subsequent step in the use of the invention where the front and rear retractable charging chamber walls are hydraulically retracted and repositioned to present an open and expanded charging chamber suitable for acceptance and accommodation of large amounts of loose media;

FIG. 11 is a cross section view along general section line B-B of FIG. 1 illustrating a subsequent step in the use of the invention where the front and rear retractable charging chamber walls are hydraulically repositioned to forcibly close and reconfigure the shape of the charging chamber to transform the state of the loose media into a bale of precompressed media;

FIG. 12 is a cross section view along general section line A-A of FIG. 1 illustrating a subsequent step in the use of the invention where the front and rear retractable charging chamber walls are hydraulically repositioned to forcibly close and reconfigure the shape of the charging chamber to transform the state of the loose media into a bale of precompressed media;

FIG. 13 is a cross section view along general section line B-B of FIG. 1 illustrating a subsequent step in the use of the invention where additional loose media is delivered to the top of the straight wall loading chamber;

FIG. 14 is a cross section view along general section line A-A of FIG. 1 illustrating a subsequent step in the use of the invention where additional loose media is delivered to the top of the straight wall loading chamber;

FIG. 15 is a cross section view along general section line A-A of FIG. 1 illustrating a subsequent step in the use of the invention where the compression ram traverses the other components of the closed and compact charging chamber to urge a bale of precompressed media from other components of the charging chamber; and, FIG. 16 is a cross section view along general section line A-A of FIG. 1 where the bale has forcibly passed from the charging chamber to the representative compression chamber.

DETAILED DESCRIPTION OF THE PREFERRED EMBODIMENT

Figure 1:
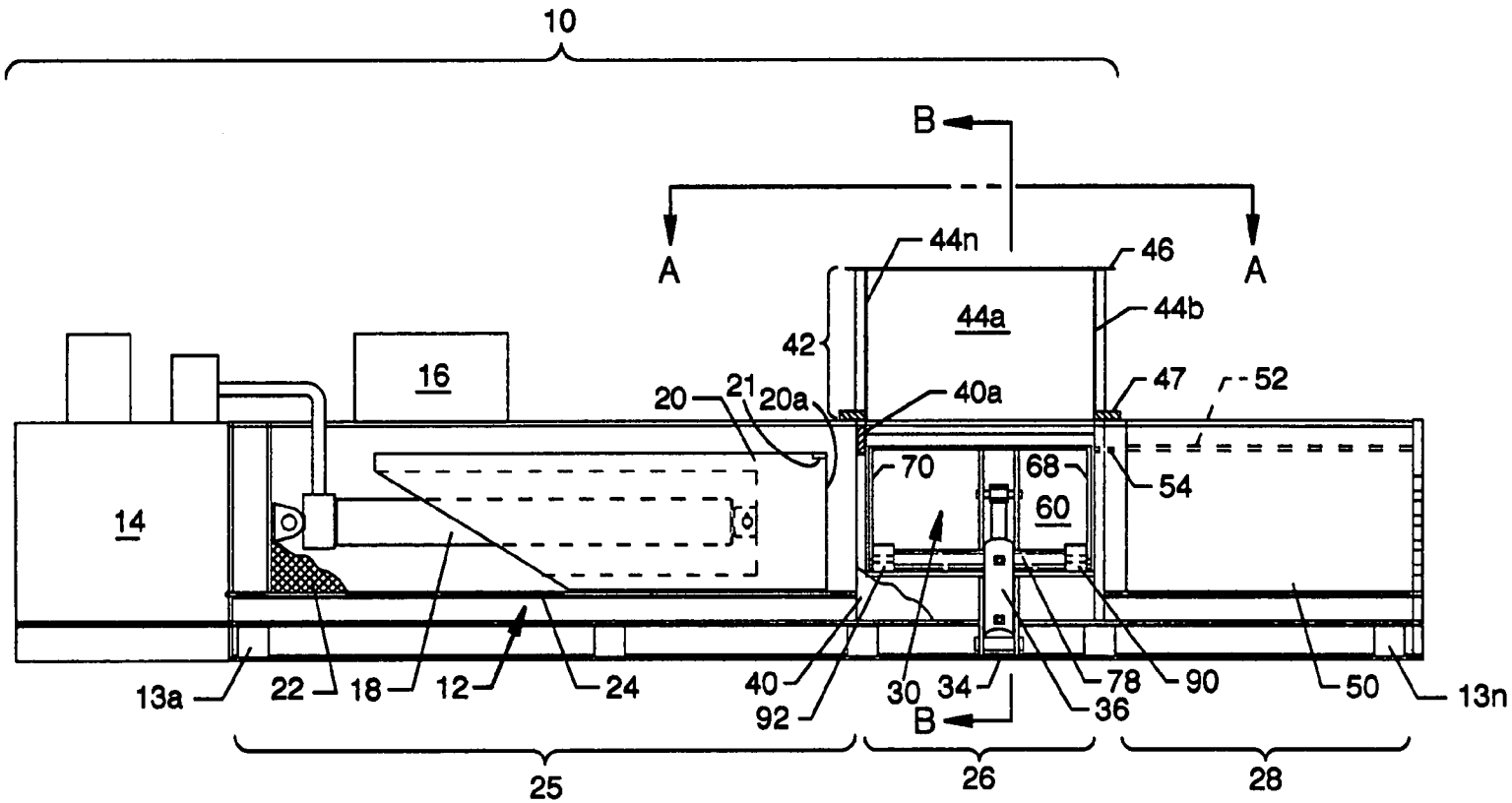
FIG. 1 is a side view partially cut away and partially in cross section of a loose media compacting apparatus including a charging chamber with retractable walls, the present invention, shown in association with a representative compression chamber.
Figure 2:
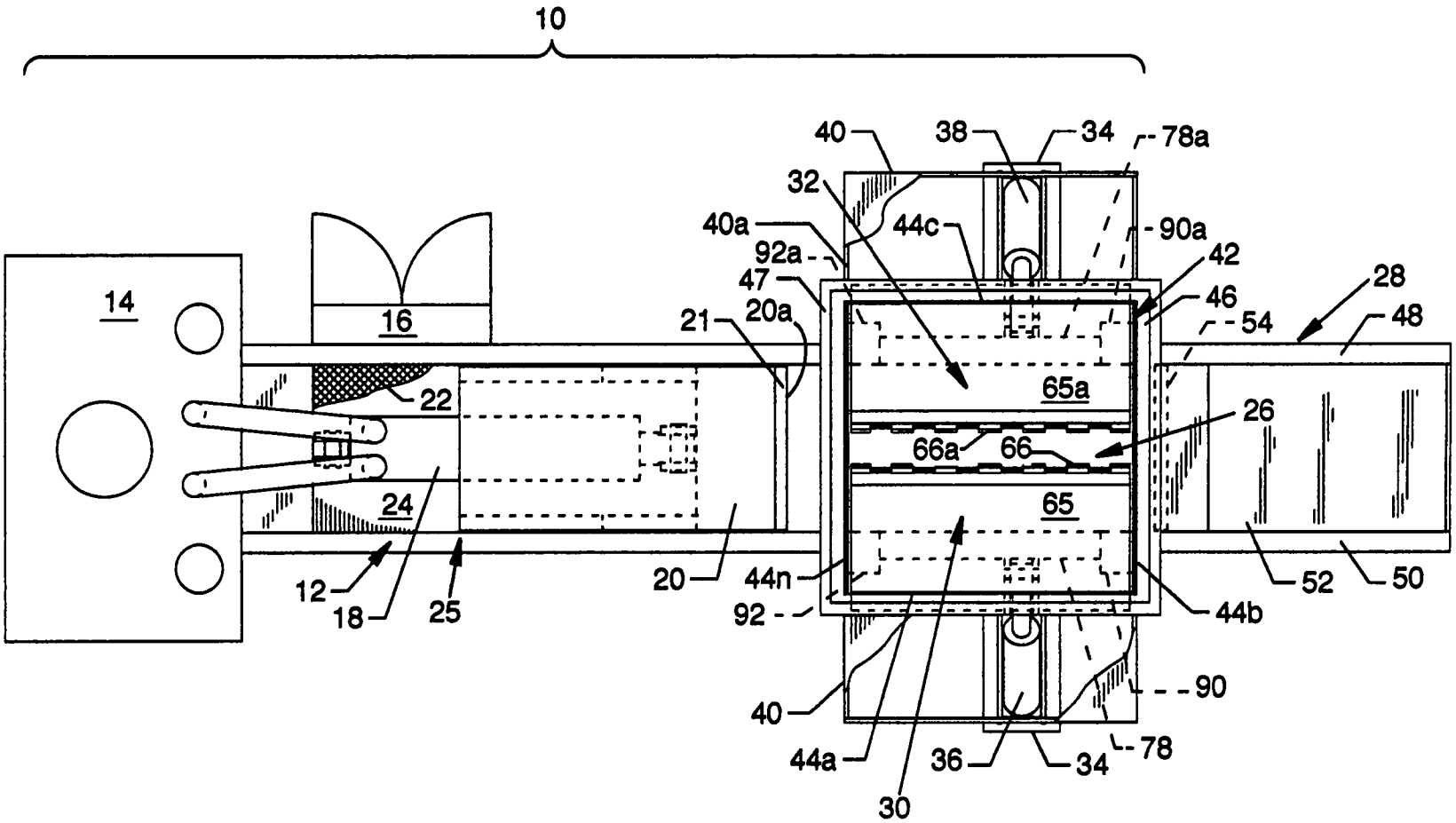
FIG. 2 is a top view of the assemblage shown in FIG. 1.

FIG. 1 is a side view partially cut away and partially in cross section and FIG. 2 is a top view of a loose media compacting apparatus 10 including a charging chamber 26 with retractable walls shown in association with a representative compression chamber 28. The loose media compacting apparatus 10 includes components mounted to or aligned along and about or associated with a framework 12 having major structures including, but not limited to, those described herein. A plurality of support feet 13*a*-13*n* are located along and are part of the framework 12. Solid or mesh protective panels 22 are shown in cutaway to provide for illustration of components located behind such protective panels. A hydraulic power center 14 and an electrical control panel 16 mount at or near one end of the framework 12. The stationary end of a main hydraulic actuating cylinder 18 secures to the framework 12 and the positionable end of the main hydraulic actuating cylinder 18 secures to a compression ram 20 located behind one or more of a plurality of protective panels 22. A shear knife 21 is located at the upper and leading edge of the compression ram 20. The compression ram 20 travels along a substantially constructed lower guide plate 24 and also aligns within a ram guide enclosure 25 (FIG. 4) located on and about the lower guide plate 24 and is guided along the lower guide plate 24 within the ram guide enclosure 25 and thence through a charging chamber 26 having variable geometry and finally into and through a representative compression chamber 28 which is shown as being located adjacent to and integrally attached with the charging chamber 26. The representative compression chamber 28 is incorporated herein for the purpose of example and demonstration to illustrate one use of the present invention. The representative compression chamber 28 can be of various types and styles and can lead to and be used with various types and styles of balers or other external equipment.

Figure 4:
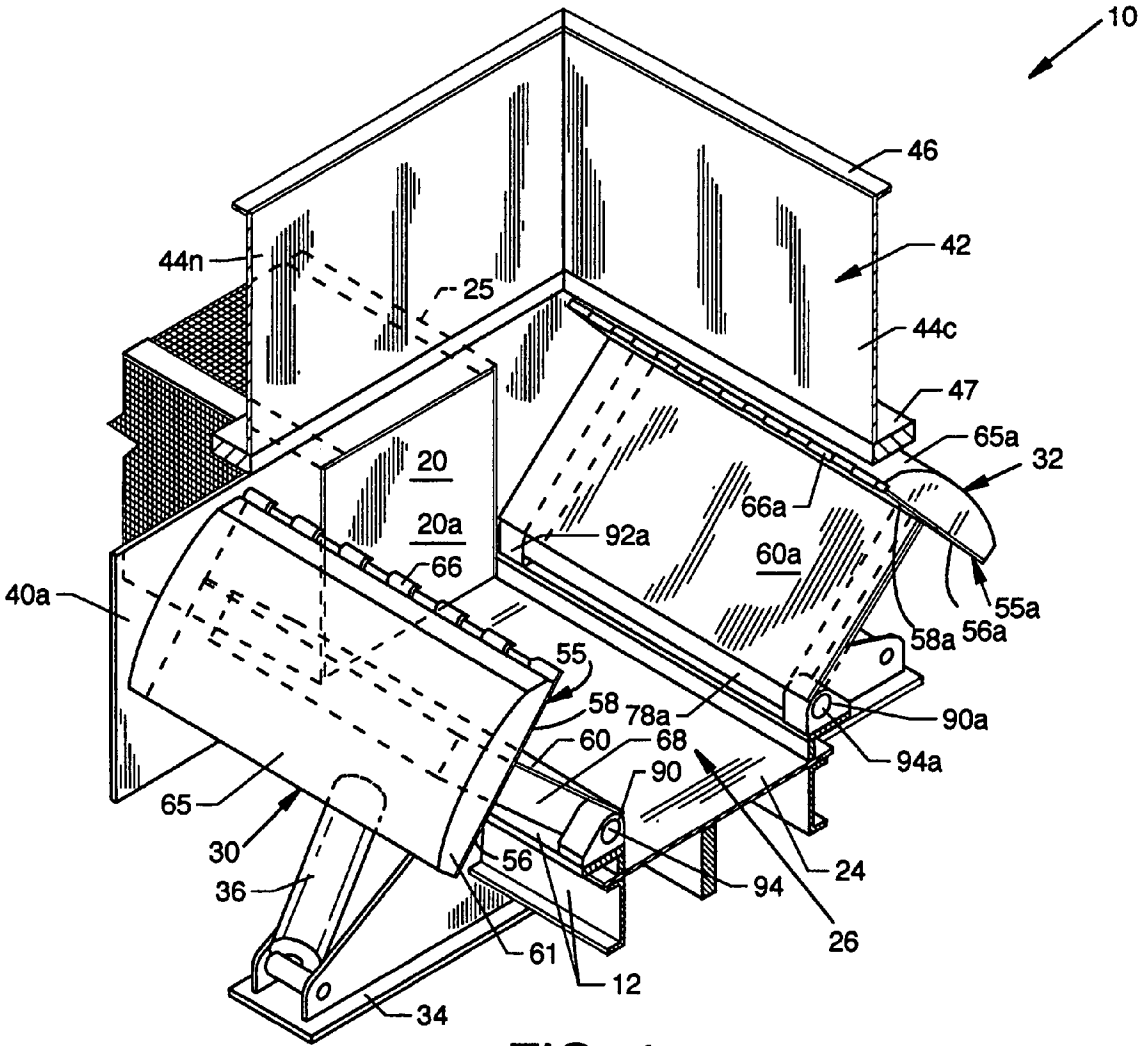
FIG. 4 is a partial cutaway isometric view illustrating the position of the front retractable charging chamber wall and the rear retractable charging chamber wall in the open and expanded position.

The charging chamber 26, shown in the open and expanded position and in detail in FIG. 4, is shown in the closed and compact position in FIGS. 1 and 2, and is partially comprised of components including a pivotable front retractable charging chamber wall 30 and an opposed similarly constructed pivotable rear retractable charging chamber wall 32 (FIG. 4), each pivotally mounted to the framework 12 juxtaposing an interspersed portion of the lower guide plate 24 which is also part of the charging chamber 26. A complete description including all components comprising the charging chamber 26 is described in detail with reference to FIG. 6.

The lower guide plate 24 extends longitudinally to be also part of the representative compression chamber 28 and part of the structure of the ram guide enclosure 25. The rear retractable charging chamber wall 32 and the front retractable charging chamber wall 30 each includes substantially vertically oriented side plates 60 and 60*a* (FIG. 4) which are oriented perpendicularly to top plates 55 and 55*a*, parts of which cooperate to impart a rectangular profile (FIG. 6) during precompression and compression modes. Mounting structure 34 secures suitably to and extends transversely across the underside of the framework 12 for pivotal mounting of the stationary end of opposed front and rear hydraulic actuating cylinders 36 and 38. The positionable ends of the opposed front and rear hydraulic actuating cylinders 36 and 38 suitably secure in pivotal fashion to the front retractable charging chamber wall 30 and to the rear retractable charging chamber wall 32, respectively. The opposed front and rear hydraulic actuating cylinders 36 and 38 operate in several modes:

a. the opposed front and rear hydraulic actuating cylinders 36 and 38 can operate to maintain the front retractable charging chamber wall 30 and the rear retractable charging chamber wall 32 in the closed and compact position;

b. the opposed front and rear hydraulic actuating cylinders 36 and 38 can operate to retract the front retractable charging chamber wall 30 and the rear retractable charging chamber wall 32 to the open and expanded position; and, c. the opposed front and rear hydraulic actuating cylinders 36 and 38 can operate to position the front retractable charging chamber wall 30 and the rear retractable charging chamber wall 32 towards and to the closed and compact position for precompression of loose media within the charging chamber 26 which ultimately assumes a closed and compact position.

Figure 9:
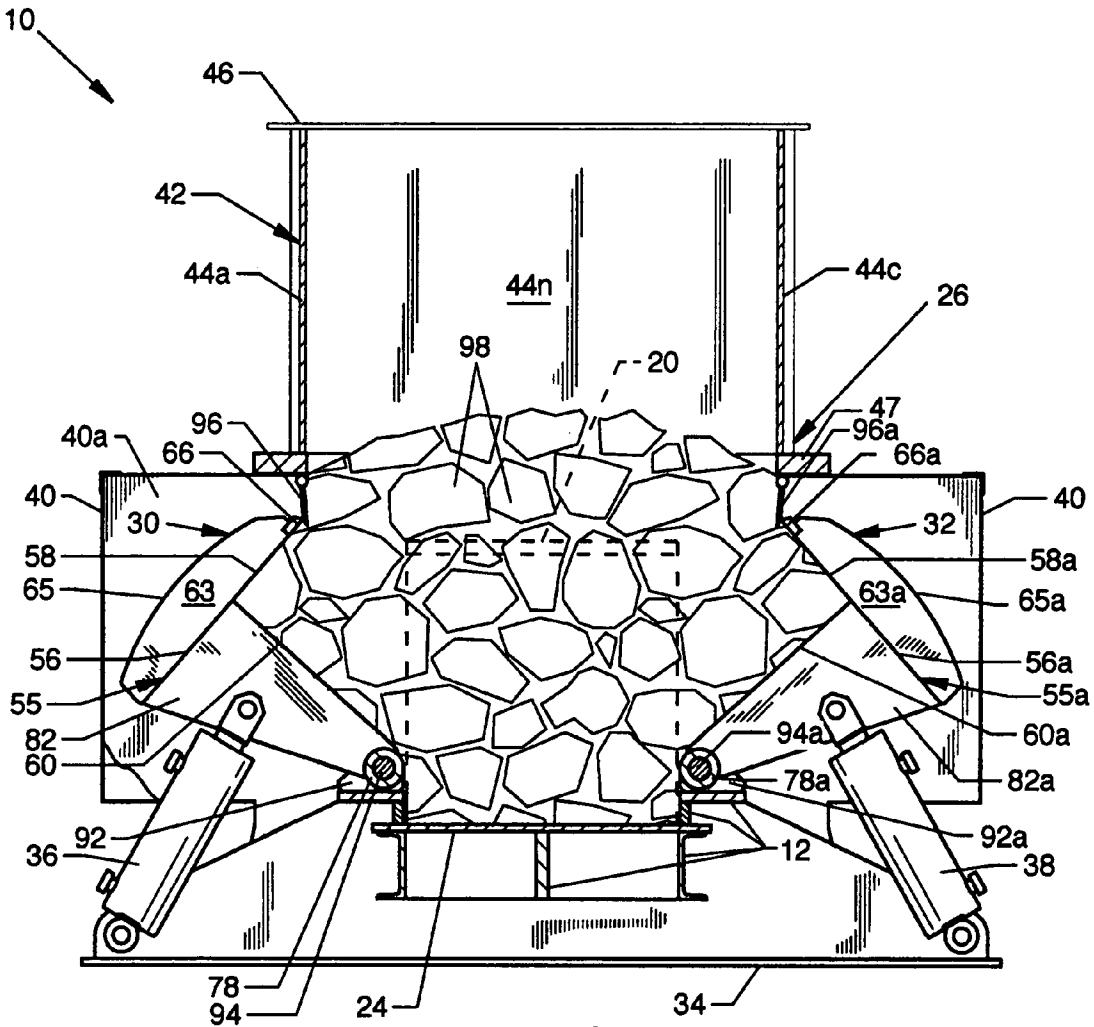

When the front retractable charging chamber wall 30 and the rear retractable charging chamber wall 32 are in the closed and compact position as shown, a barrier between a loading chamber 42 and the charging chamber 26 is formed by arcuate structure of the intervening front and rear retractable charging chamber walls 30 and 32, thereby preventing full and direct communication of the loading chamber 42 with the charging chamber 26, while also providing structure for support and control of incoming loose media in the loading chamber 42, as described later in detail. A protective panel assembly 40, which can be mesh or which can be a solid structure, is shown partially in cutaway in FIG. 1 surrounding the operating portions of the front retractable charging chamber wall 30 and the rear retractable charging chamber wall 32, as well as the front hydraulic actuating cylinder 36 and the rear hydraulic actuating cylinder 38. The loading chamber 42, having connected vertically oriented straight wall panels 44*a*-44*n* and an upper flange 46 at the upper edges thereof, secures via a lower flange 47 to the upper region of the framework 12, and aligns above and with the charging chamber 26. The relationship of the loading chamber 42 to the charging chamber 26 is such that a cross section taken horizontally across the loading chamber 42 is greater than a like cross section taken horizontally across the charging chamber 26 in the closed and compact position. Accordingly, the front retractable charging chamber wall 30 and the rear retractable charging chamber wall 32 are retracted outwardly and expandingly by action of the front and rear hydraulic actuating cylinders 36 and 38 to disallow the barrier interference to allow loose media to be distributed from the loading chamber 42 into the awaiting expanded cross section charging chamber 26 produced by the deployed front and rear retractable charging chamber walls 30 and 32, such as shown in FIG. 9. Such an arrangement allows greater and more abundant amounts of loose media to be received into and to be processed by the charging chamber 26 of expanded capacity than that of a generic charging chamber of lesser capacity.

The representative compression chamber 28 is shown located in close association adjacent to and aligned with the charging chamber 26 utilizing a portion of the lower guide plate 24 and is shown as including side walls 48 and 50 secured on the framework 12 along and about the lower guide plate 24 and a top wall 52 secured to and between the upper regions of the side walls 48 and 50. A shear beam knife 54 is located appropriately at the upper entry end of the representative compression chamber 28 for interaction with the shear knife 21 mounted on the compression ram 20.

Figure 3:
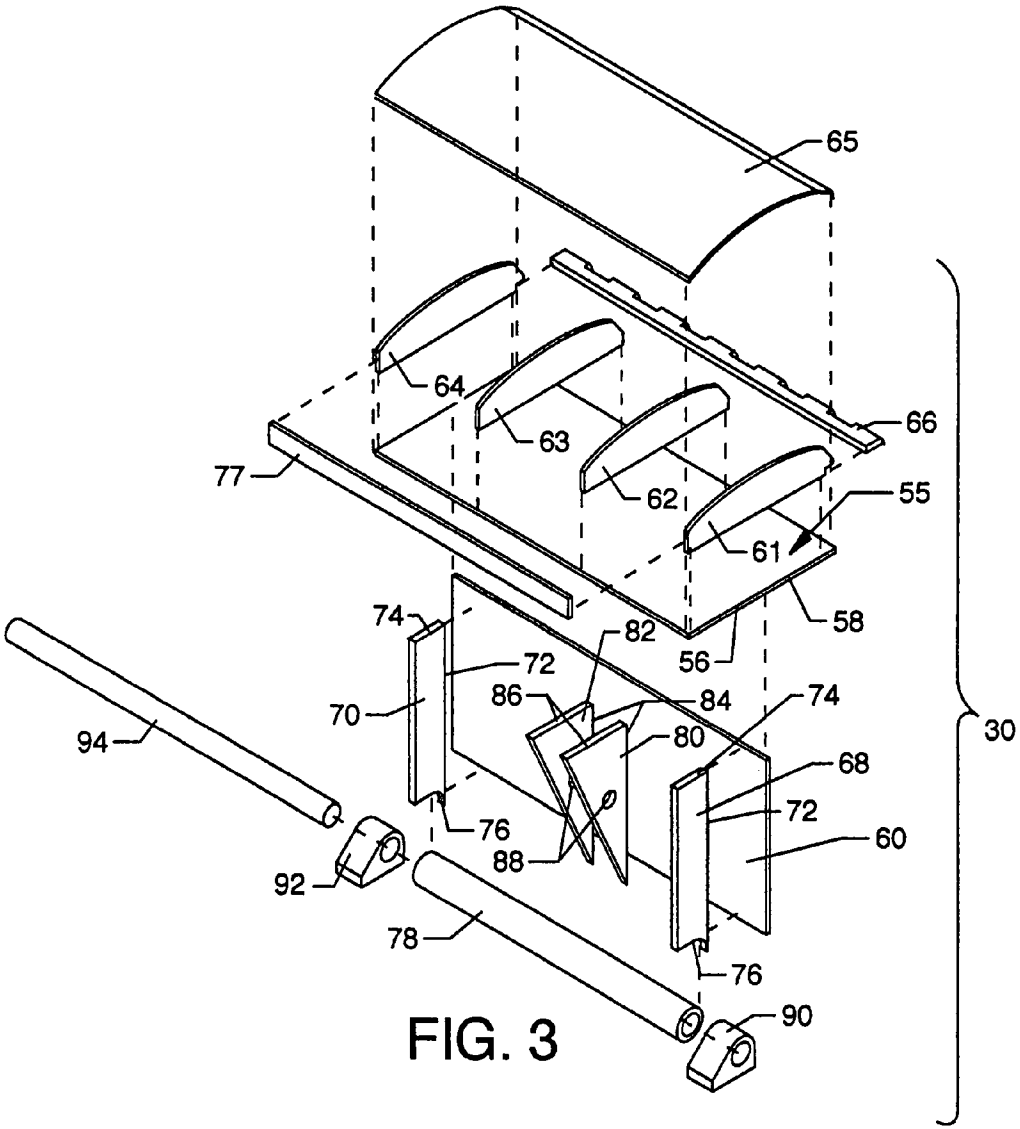
FIG. 3 is an exploded isometric view of a front retractable charging chamber wall and associated parts showing the structure and arrangements of the components thereof.

FIG. 3 is an exploded view of the front retractable charging chamber wall 30 and associated parts showing the structure and arrangements of the components thereof which are identical to those components comprising the rear retractable charging chamber wall 32. The rear retractable charging chamber wall 32, such as shown in FIG. 4, is of like and similar construction and function and includes similar components which are related directly to those components of the front retractable charging chamber wall 30 and which, correspondingly, are given like reference numerals appended with the letter "a". FIG. 3 illustrates the front retractable charging chamber wall 30 in the general position and orientation observed when maximum precompression or compression occurs; and FIG. 4 illustrates the retraction of the front retractable charging chamber wall 30 and the rear retractable charging chamber wall 32 to the open and expanded position. Reference is made to the exploded view of FIG. 3 and to the assembled view shown in FIG. 4. With reference to the illustrated orientation of FIG. 3, the front retractable charging chamber wall 30 is now described. A one-piece planar top plate 55 involves sections including an outwardly directed top plate section 56 continuous with an inwardly directed top plate section 58. A planar side plate 60 intersects and secures to the planar top plate 55 in perpendicular fashion and delineates the division of the planar top plate 55 into the outwardly directed top plate section 56 and the inwardly directed top plate section 58. A plurality of arcuate support plates 61, 62, 63 and 64 align perpendicularly to and suitably secure to the upper side of the top plate 55 in order to accommodate an arcuate top cover plate 65 as well as a serrated knife 66 suitably secured thereto. Similarly constructed end panels 68 and 70 each includes an inwardly facing edge 72, a top edge 74, and an arcuate bottom edge 76. The top edges 74 of the end panels 68 and 70 align and suitably secure to the underside surface and near the edge of the outwardly directed top plate section 56, and the inwardly facing edges 72 of the end panels 68 and 70 align and suitably secure to the outwardly facing surface of and near the edge of the side plate 60. A horizontally oriented side plate 77 secures between the near edges of the arcuate top cover plate 65 and the top plate 55, as well as to the near ends of the arcuate support plates 61, 62, 63 and 64. The ends of a pivot tube 78 align to and suitably secure to the arcuate bottom edges 76 of the end panels 68 and 70. Centrally located and similarly constructed and opposed brackets 80 and 82 each includes an inwardly facing edge 84, a top edge 86, and a mounting hole 88. The top edges 86 of the brackets 80 and 82 align and suitably secure to the underside surface of the outwardly directed top plate section 56, and the inwardly facing edges 84 of the brackets 80 and 82 align and suitably secure to the outwardly facing surface of the side plate 60 for accommodation of the positionable end of the front hydraulic actuating cylinder 36 suitably secured thereto. Pivot mounts 90 and 92 (FIG. 3) and 90 a and 92 a (FIG. 4) secure to the framework 12 to accommodate pivot rods 94 and 94 a which extend through the pivot tubes 78 and 78 a to pivotally secure the front retractable charging chamber wall 30 and the rear retractable charging chamber wall 32 to the framework 12.

FIG. 4 is a partial cutaway isometric view of the loading chamber 42 and the charging chamber 26 where the opposed front and rear retractable charging chamber walls 30 and 32, respectively, have been retracted to provide a charging chamber 26 in the open and expanded position, such as for reception of loose media from the loading chamber 42. Shown in particular is the pivotal mounting of the front retractable charging chamber wall 30 and the rear retractable charging chamber wall 32 to the framework 12 where each is operated near and in close proximity to the lower guide plate 24. A transversely mounted and vertically oriented panel 40*a*, which is part of the protective panel assembly 40, is shown at the end of the ram guide enclosure 25 in close proximity and alignment to and with the components of the charging chamber 26 described in detail with reference to FIG. 6. The panel 40*a* acts in concert with the open and expanded charging chamber 26 to constrain media within the general region of the open and expanded charging chamber 26 when the front and rear retractable charging chamber walls 30 and 32 are retracted to form an open and expanded charging chamber 26.

Figure 5:
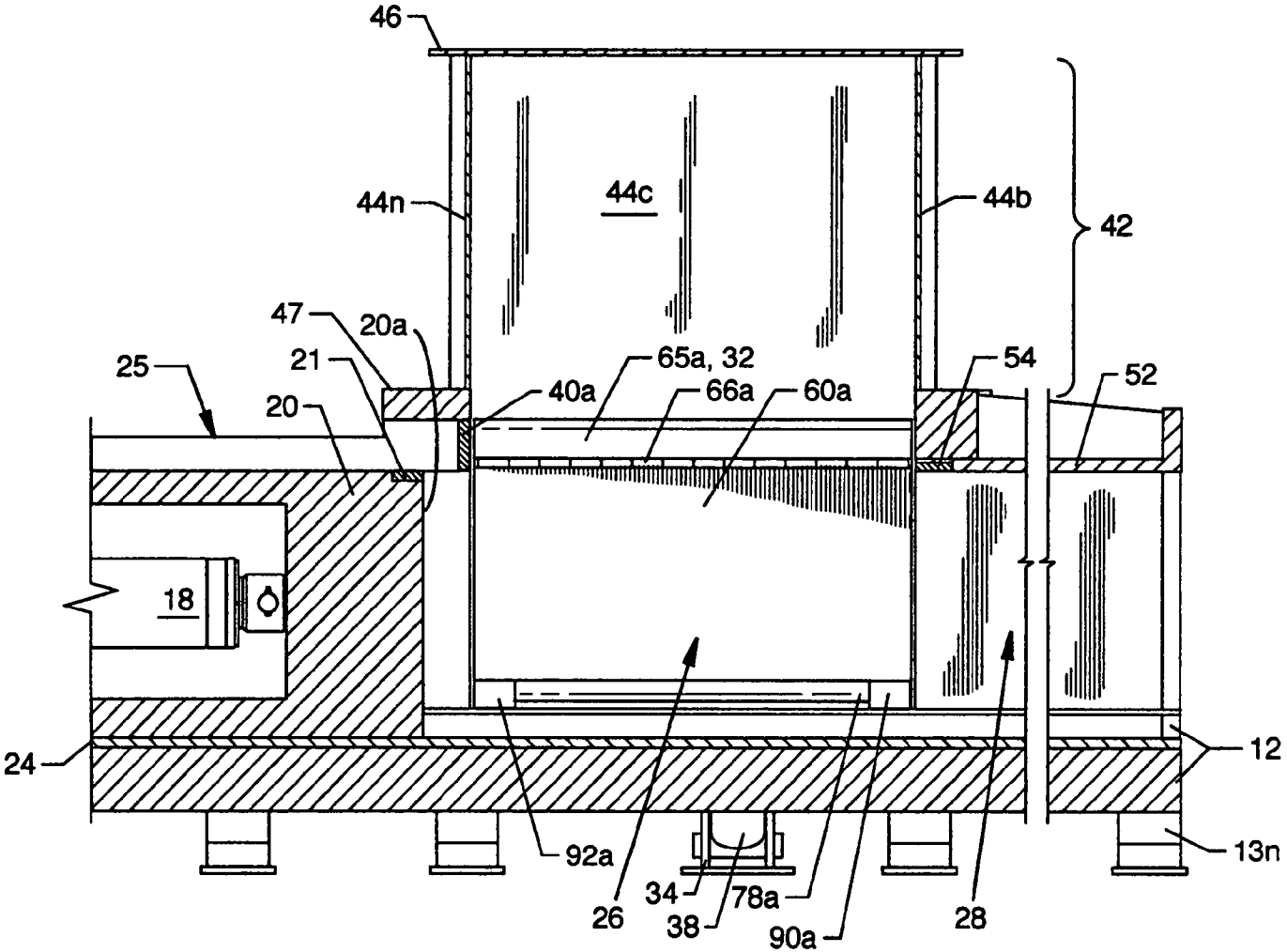
FIGS. 5-16 utilize general section lines A-A and B-B for viewing various and different configurations of the invention, as described herein.

FIG. 5 is a cross section view along general section line A-A of FIG. 1, where the rear retractable charging chamber wall 32 and the front retractable charging chamber wall 30 (not shown) are positioned in the closed and compact position. Shown in particular is the general box-like shape of the charging chamber 26.

Figure 6:
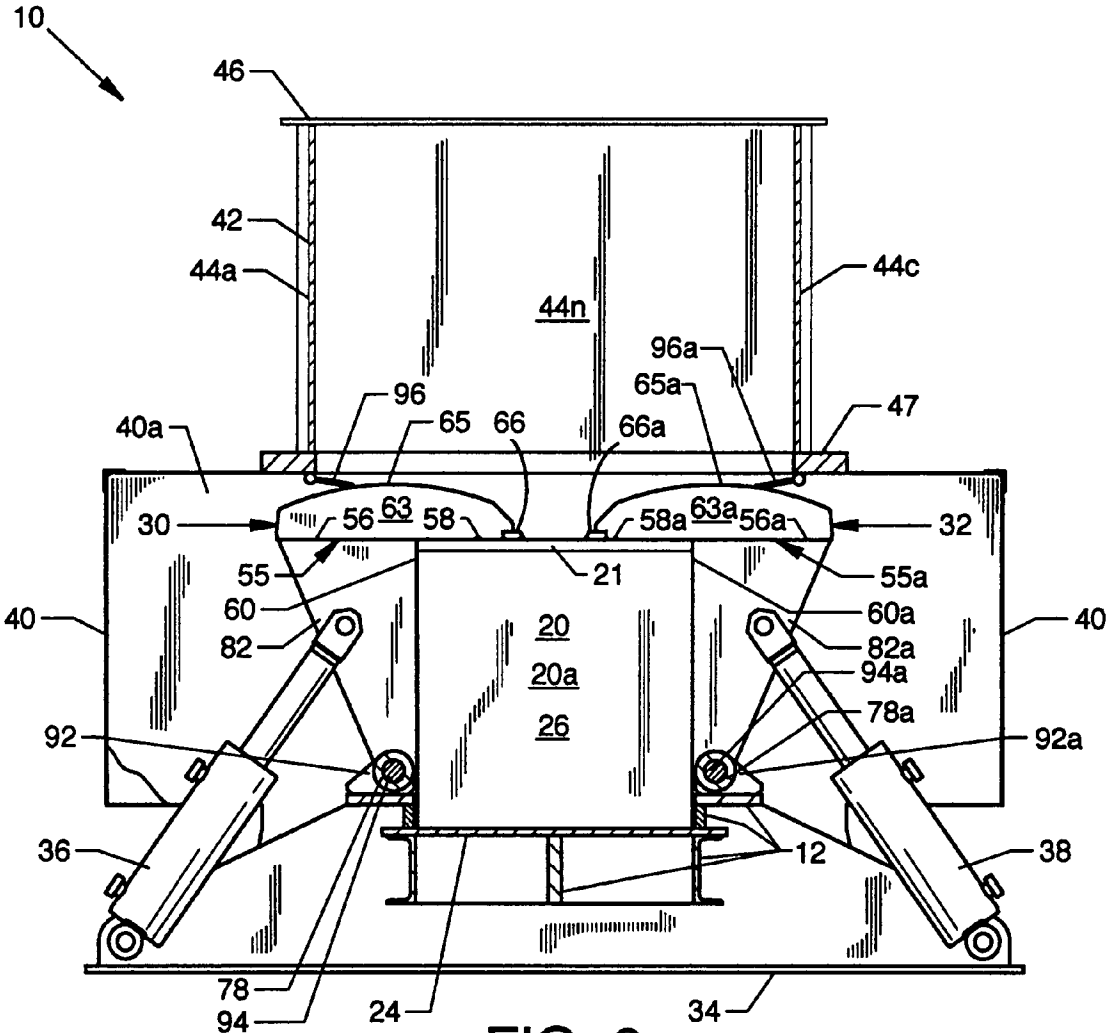

FIG. 6 is a cross section view along general section line B-B of FIG. 1, where the rear retractable charging chamber wall 32 and the front retractable charging chamber wall 30 are positioned in the closed and compact position, thus delineating the general box-like shape of the closed and compact charging chamber 26, such as when precompressing media. In the closed and compact position, the serrated knives 66 and 66*a* are spaced in close mutual proximity having a short distance therebetween. Opposed seal flaps 96 and 96*a* mount at or in close proximity to the lower edges of the straight wall panels 44*a* and 44*c* of the loading chamber 42 to seal against the arcuate top cover plates 65 and 65*a* of the front and rear retractable charging chamber walls 30 and 32, respectively. With reference to both FIGS. 5 and 6, the charging chamber 26 in the closed position is formed by a portion of the lower guide plate 24, the vertically aligned side plates 60 and 60*a* of the front and rear retractable charging chamber walls 30 and 32, the inwardly directed top plate sections 58 and 58*a* of the top plates 55 and 55*a*, the serrated knives 66 and 66*a*, the seal flaps 96 and 96*a*, and the vertically aligned leading surface 20*a* of the compression ram 20. Of these components comprising the charging chamber 26, the front and rear retractable charging chamber walls 30 and 32 and parts thereof, the seal flaps 96 and 96*a*, and the leading surface 20*a* of the compression ram 20 are either moveable or positionable to incorporate variable geometry to form and provide a closed and compact charging chamber 26 or an open and expanded charging chamber 26.

Mode of Operation

FIGS. 7-16 illustrate the mode of operation of the present invention.

Figure 7:
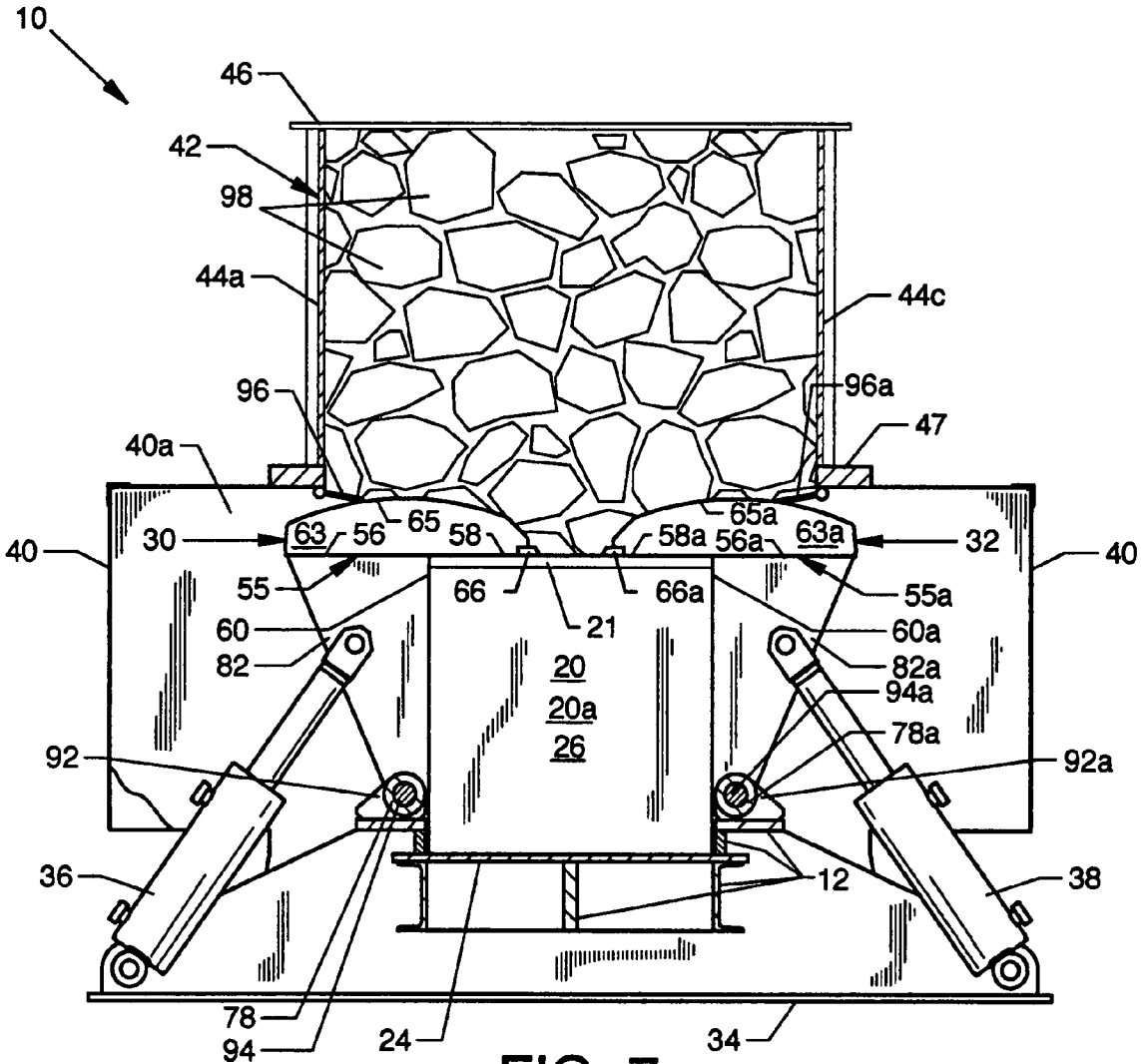
Figure 8:
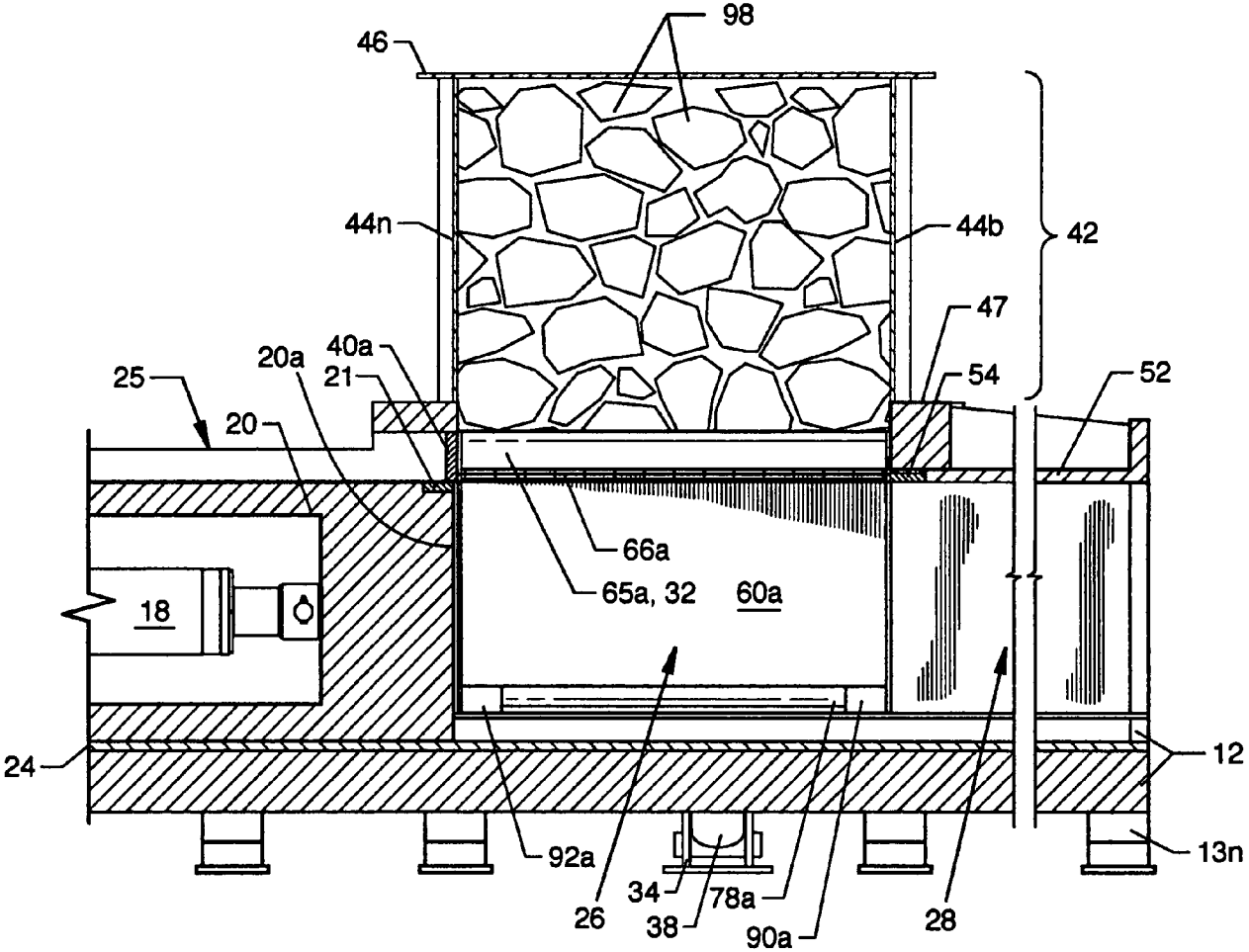

FIG. 7 is a cross section view along general section line B-B of FIG. 1, and FIG. 8 is a cross section view along general section line A-A of FIG. 1 illustrating the initial step in the use of the invention where the front and rear retractable charging chamber walls 30 and 32 are hydraulically positioned by the front and rear hydraulic actuating cylinders 36 and 38, respectively, thereby forming a closed and compact charging chamber 26 structured as previously described. Loose media 98, which is to be fully precompressed and compressed mostly by the invention and prior to final baling by downline baling structure, is delivered by a suitably wide conveyor or other desired means to the top of the straight wall loading chamber 42 where the loose media 98 is gravitationally delivered thereinto to rest on and be supported by the arcuate top cover plates 65 and 65*a* of the front and rear retractable charging chamber walls 30 and 32. During this step, the loose media 98 is located at a location above the closed and compact charging chamber 26 for momentary holding in the loading chamber 42 to await processing for starting to form a new bale or to await the completion of a previously started bale being processed in the charging chamber 26 and/or the adjacent representative compression chamber 28. Any previously started bales undergoing formation in the charging chamber 26 and/or the representative compression chamber 28 are not shown for purposes of brevity and clarity and are considered to have a minor significant relationship with the loose media 98 awaiting processing contained in the loading chamber 42. Precompressed media being processed in the charging chamber 26 can prevent entry of loose media 98 through the spaced serrated knives 66 and 66*a* into the charging chamber 26, although the loose media 98 may be of sufficient size by itself to preclude entry into the charging chamber 26.

In FIG. 8, the compression ram 20 is shown positioned away from the other components forming the charging chamber 26 to await hydraulic actuated retraction of the front and rear retractable charging chamber walls 30 and 32 by the front and rear hydraulic actuating cylinders 36 and 38, respectively, to allow unrestricted gravitational free fall of loose media 98.

Figure 10:
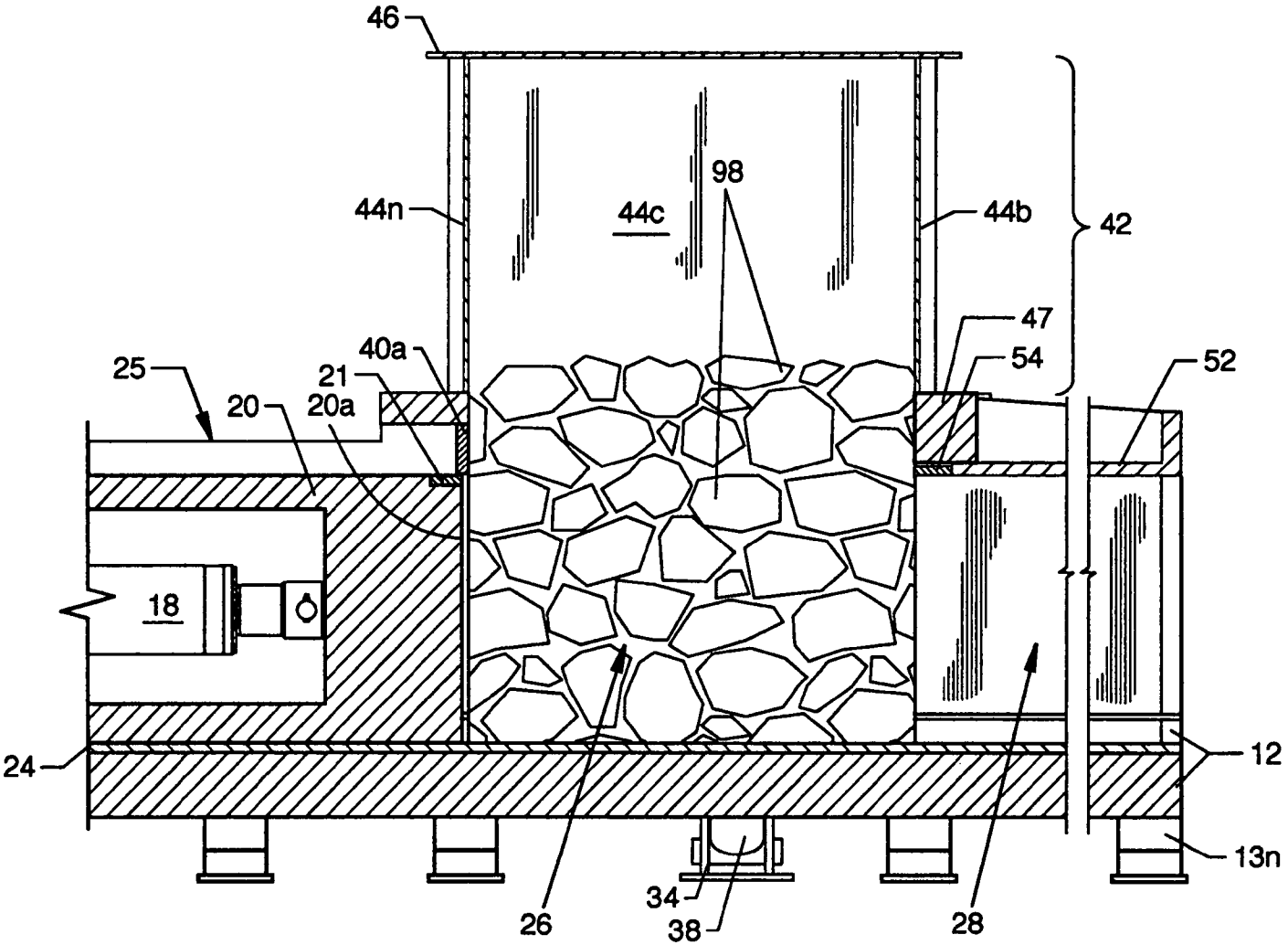

FIG. 9 is a cross section view along general section line B-B of FIG. 1, and FIG. 10 is a cross section view along general section line A-A of FIG. 1 illustrating a subsequent step in the use of the invention where the front and rear retractable charging chamber walls 30 and 32 are hydraulically retracted and repositioned by action of the front and rear hydraulic actuating cylinders 36 and 38, respectively, to present an open and expanded charging chamber 26 suitable for acceptance and accommodation of large amounts of loose media 98. Such hydraulic action causes the front and rear retractable charging chamber walls 30 and 32 to retractively pivot about the pivot rods 94 and 94*a* shown in FIG. 4. During such retraction, the side plates 60 and 60*a* and the top plates 55 and 55*a* of the front and rear retractable charging chamber walls 30 and 32 are reoriented to a position other than vertical or horizontal, as shown. During the retracting of the front and rear retractable charging chamber walls 30 and 32, support of the overlying loose media 98 is withdrawn when the arcuate top cover plates 65 and 65*a* diverge. Such divergence and support withdrawal allows gravity to urge free flow of the loose media 98 from and through the loading chamber 42 into the open and expanded charging chamber 26 to impinge side plates 60 and 60*a* of the retracted front and rear retractable charging chamber walls 30 and 32, to fill toward and against the inwardly directed top plate sections 58 and 58*a* of the retracted front and rear retractable charging chamber walls 30 and 32, to be deposited on the lower guide plate 24 which in part forms the charging chamber 26, and to fill toward and against the panel 40*a* which is incorporated into use with the open and expanded charging chamber 26. Such retraction of the front and rear retractable charging chamber walls 30 and 32 offers an open and expanded charging chamber 26 having a large and wide reception area of sufficient volume to receive a sufficiently sized loose media load which, prior to precompressing, preferably contains a suitable amount of loose media 98 to require only a single filling of the open and expanded charging chamber 26.

In FIG. 10, the leading surface 20*a* of the compression ram 20 is shown positioned in close proximity to the other components to form one end of the open and expanded charging chamber 26. Such positioning of the leading surface 20*a* contains the loose media 98 in the general area of the open and expanded or closed and compact charging chamber 26. In the alternative, the compression ram 20 can be positioned a short distance toward the main hydraulic actuating cylinder 18 to accommodate more loose media 98.

Figure 11:
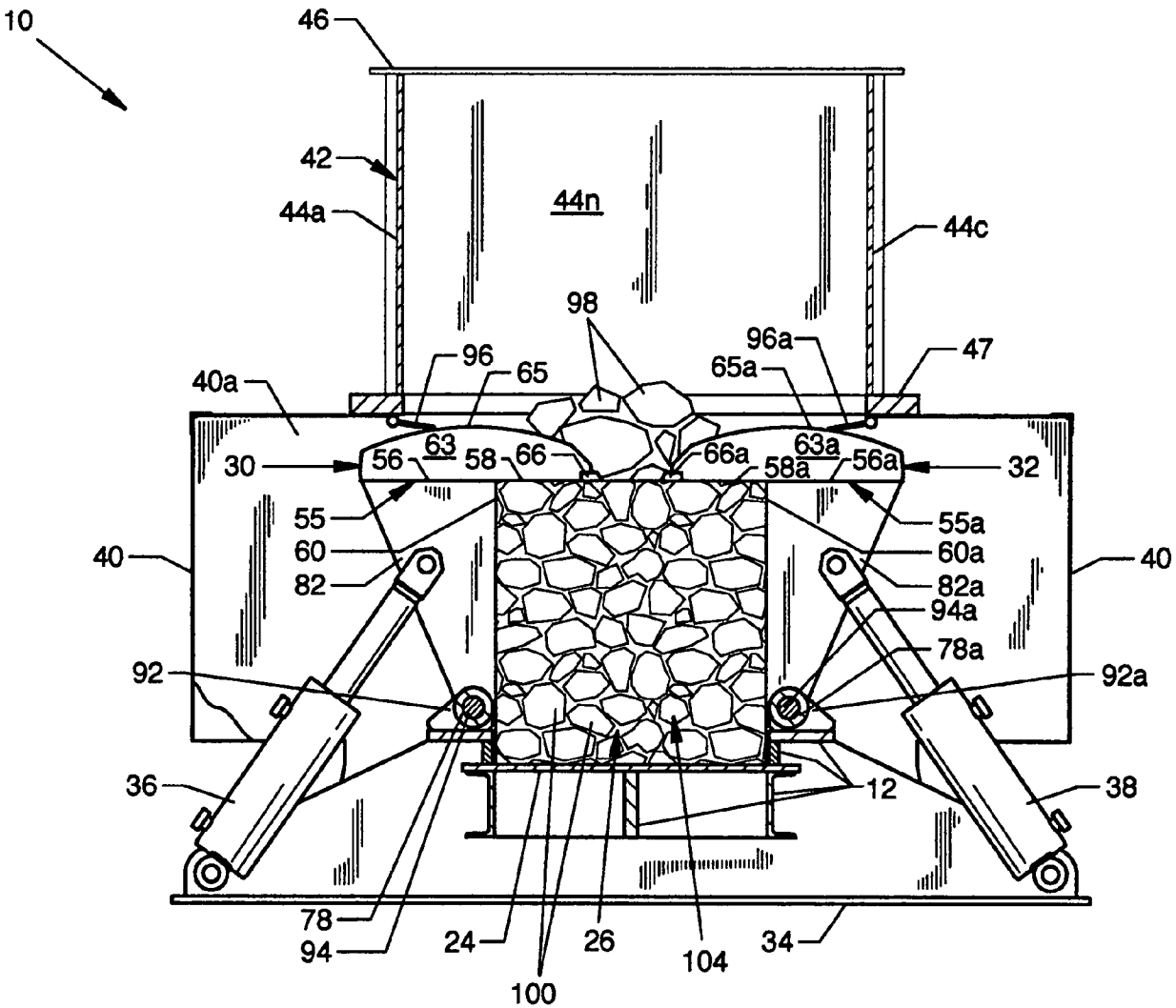
Figure 12:
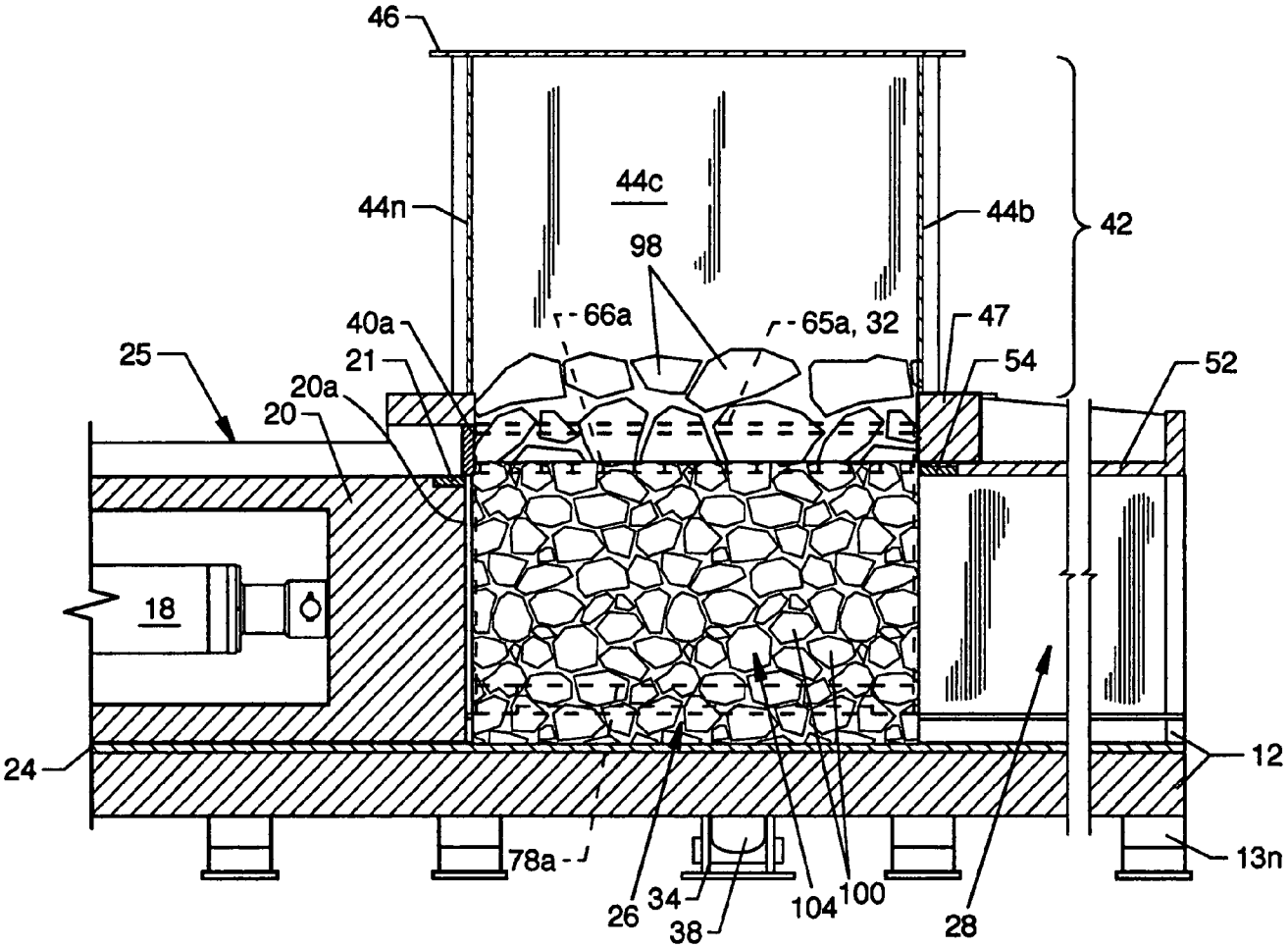

FIG. 11 is a cross section view along general section line B-B of FIG. 1, and FIG. 12 is a cross section view along general section line A-A of FIG. 1 illustrating a subsequent step in the use of the invention where the front and rear retractable charging chamber walls 30 and 32 are hydraulically repositioned by action of the front and rear hydraulic actuating cylinders 36 and 38, respectively, to forcibly close and reconfigure the shape of the charging chamber 26 to the closed and compact configuration to transform the state of the loose media 98 into a bale 104 of precompressed media 100. The serrated knives 66 and 66*a* at the inner ends of the front and rear retractable charging chamber walls 30 and 32 enable cutting of loose media 98 at the upper and central region of the charging chamber 26 during forcible positioning of the front and rear retractable charging chamber walls 30 and 32 to the closed and compact position. Such cutting separates excess loose media 98 which remains supported by the arcuate top cover plates 65 and 65*a* and contained in the lower region of the loading chamber 42 from the precompressed media 100 which is forcibly contained in the closed and compact charging chamber 26. At this time the precompressed media 100 may be removed from the charging chamber 26 by the compression ram 20.

Figure 13:
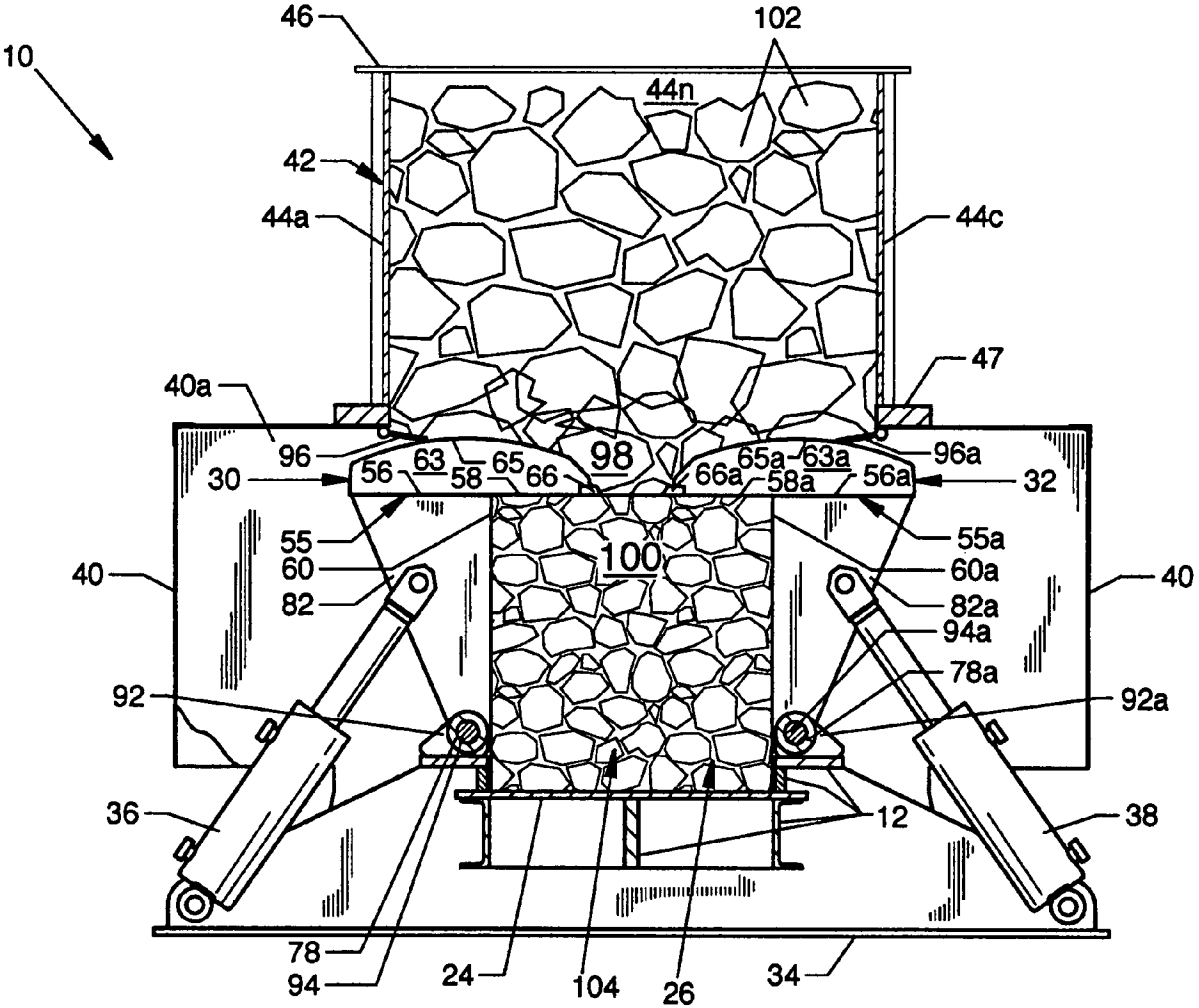
Figure 14:
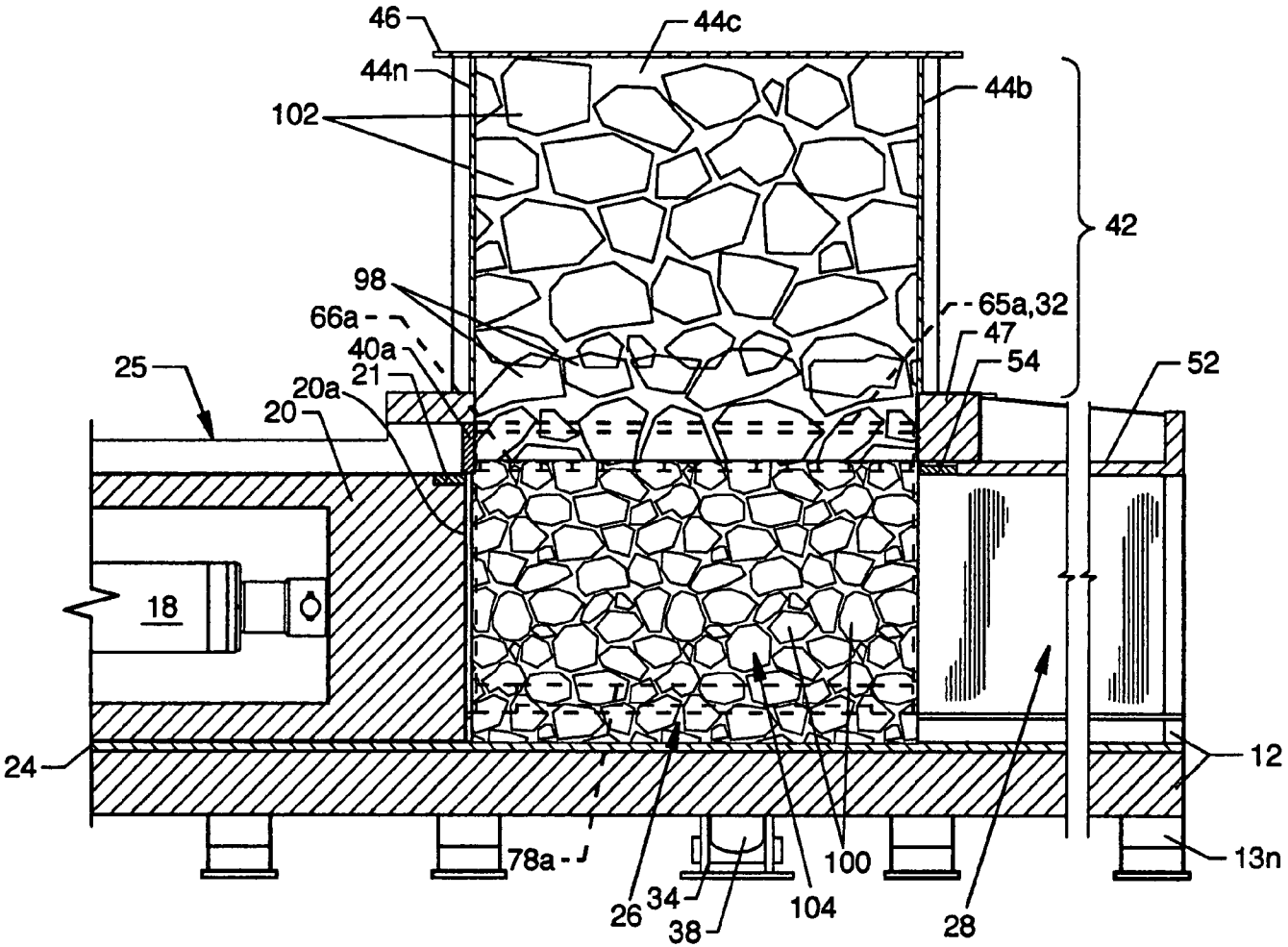

FIG. 13 is a cross section view along general section line B-B of FIG. 1, and FIG. 14 is a cross section view along general section line A-A of FIG. 1 illustrating a subsequent step in the use of the invention where additional loose media 102 is delivered to the top of the straight wall loading chamber 42 and gravitationally delivered thereinto to commingle with the remaining original loose media 98 and to rest on the remaining original loose media 98 and/or the arcuate top cover plates 65 and 65*a* of the front and rear retractable charging chamber walls 30 and 32. This step is shown taking place prior to removal of a bale from the charging chamber 26, but, alternatively, this step could take place subsequent to bale removal.

Figure 15:
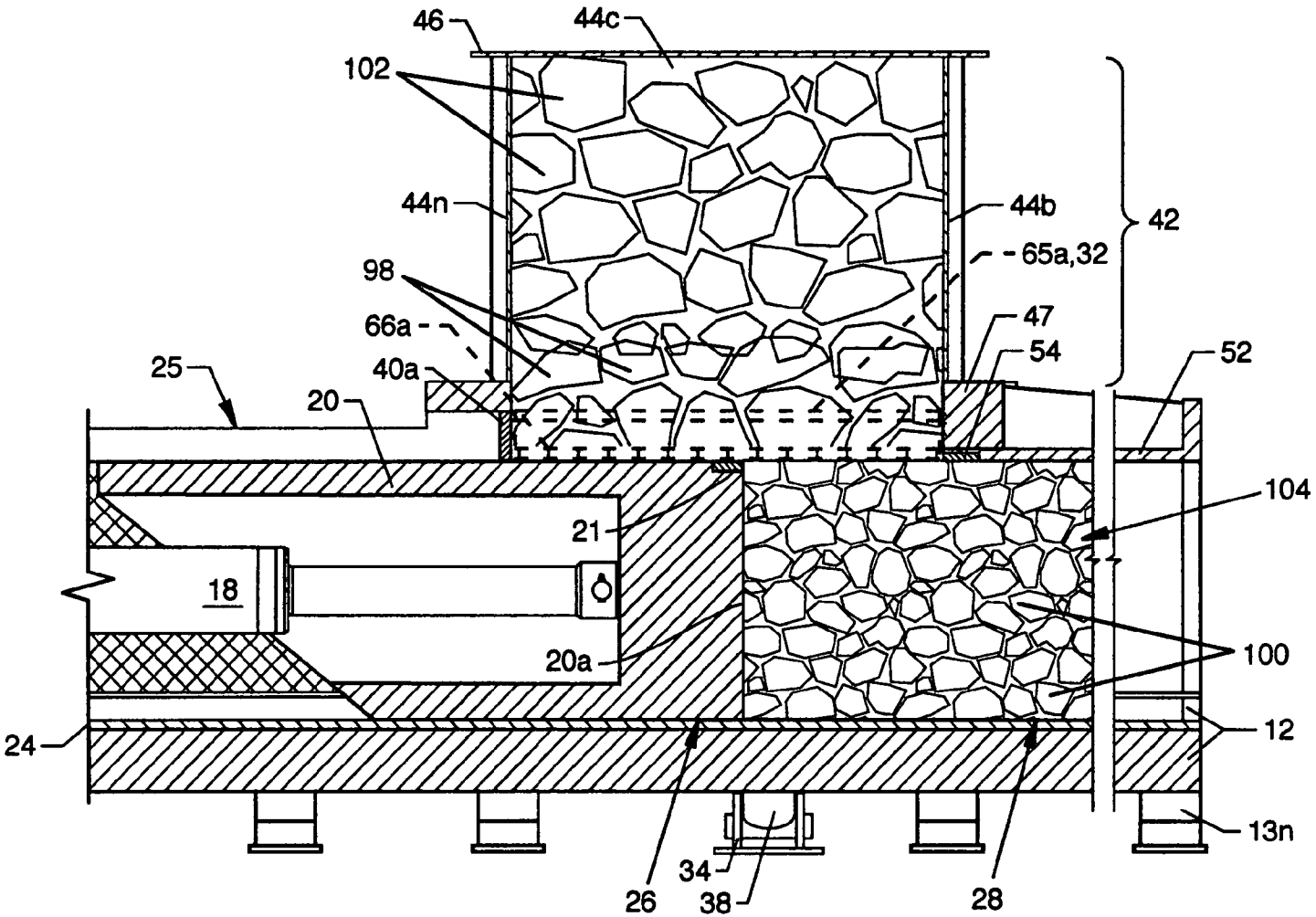

FIG. 15 is a cross section view along general section line A-A of FIG. 1 illustrating a subsequent step in the use of the invention where the compression ram 20 is driven by the main hydraulic actuating cylinder 18 to traverse the other components of the closed and compact charging chamber 26 to urge the bale 104 of precompressed media 100 from the charging chamber 26. During forced movement of the bale 104 by the ram 20, cutting, tearing, separation, or shearing of bale media occurs in several fashions. Bale media forcibly engaged between the serrated knives 66 and 66*a* is cut and/or torn to separate loose media 98 above the serrated knives 66 and 66*a* from any precompressed media 100 extending upwardly from but still associated with the bale 104. Additionally, the shear knife 21 at the upper leading surface 20*a* of the ram 20 cooperates with the shear beam knife 54 at the edge of the representative compression chamber 28 to shear and cut any media extending between the charging chamber 26 and the representative compression chamber 28 to ensure complete separation of the bale 104.

Figure 16:
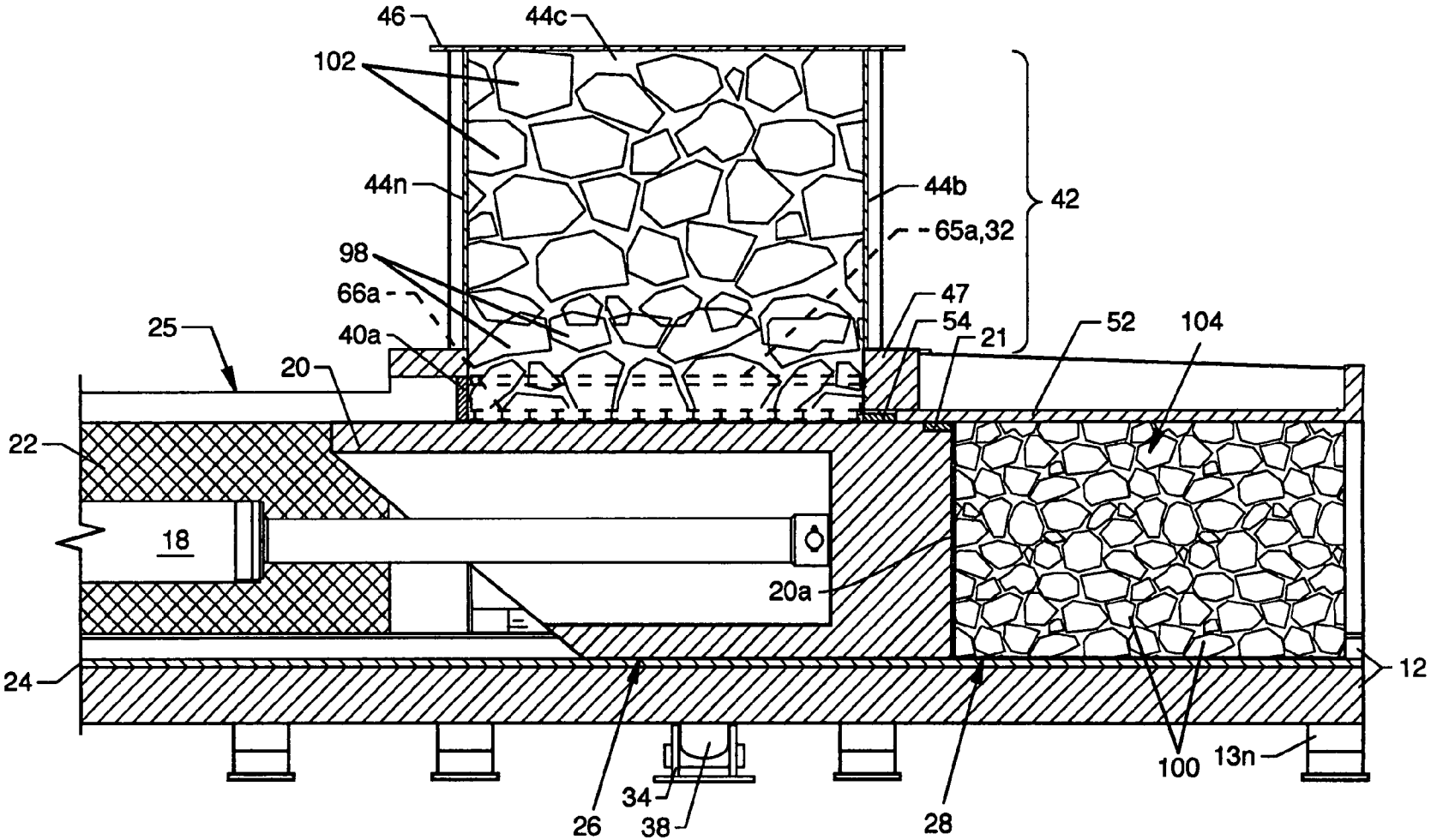

FIG. 16 is a cross section view along general section line A-A of FIG. 1 where the bale 104 has forcibly passed from the charging chamber 26 just past the junction of the shear knife 21 and the shear beam knife 54 and urged into the representative compression chamber 28 where compression utilizing the compression ram 20 can be effected, if required. Upon ejection of the bale 104 from the charging chamber 26 and suitably timed withdrawal of the ram 20, the entire process can be repeated and continued as previously described by actuating the front and rear retractable charging chamber walls 30 and 32 to the open and expanded position to present an open and expanded charging chamber 26 to accept gravitational deposition of media from the loading chamber 42, or in a modified sequence which best operationally benefits efficient operation of the loose media compacting apparatus 10. Symmetric operation involving simultaneous actuation of the front and rear retractable charging chamber walls 30 and 32 causes the media to be compressed equally along each side of the longitudinal centerline of the loose media compacting apparatus 10, thereby eliminating or significantly reducing unevenness of the precompressed bales.

Various modifications can be made to the present invention without departing from the apparent scope hereof.

LOOSE MEDIA COMPACTING APPARATUS INCLUDING A CHARGING CHAMBER WITH RETRACTABLE WALLS PARTS LIST

| | |
|---|---|
| 10 | loose media compacting apparatus |
| 12 | framework |
| 13a-n | support feet |
| 14 | hydraulic power center |
| 16 | electrical control panel |
| 18 | main hydraulic actuating cylinder |
| 20 | compression ram |
| 20a | leading surface |
| 21 | shear knife |
| 22 | protective panel |
| 24 | lower guide plate |
| 25 | ram guide enclosure |
| 26 | charging chamber |
| 28 | representative compression chamber |
| 30 | front retractable charging chamber wall |
| 32 | rear retractable charging chamber wall |
| 34 | mounting structure |
| 36 | front hydraulic actuating cylinder |
| 38 | rear hydraulic actuating cylinder |
| 40 | protective panel assembly |
| 40a | panel |
| 42 | loading chamber |
| 44a-n | straight wall panels |
| 46 | upper flange |
| 47 | lower flange |
| 48 | side wall |
| 50 | side wall |
| 52 | top wall |
| 54 | shear beam knife |
| 55 | top plate |
| 55a | top plate |
| 56 | outwardly directed top plate section |
| 56a | outwardly directed top plate section |
| 58 | inwardly directed top plate section |
| 58a | inwardly directed top plate section |
| 60 | side plate |
| 60a | side plate |
| 61 | arcuate support plate |
| 62 | arcuate support plate |
| 63 | arcuate support plate |
| 63a | arcuate support plate |
| 64 | arcuate support plate |
| 65 | arcuate top cover plate |
| 65a | arcuate top cover plate |
| 66 | serrated knife |
| 66a | serrated knife |
| 68 | end panel |
| 70 | end panel |
| 72 | inwardly facing edge |
| 74 | top edge |
| 76 | arcuate bottom edge |
| 77 | side plate |
| 78 | pivot tube |
| 78a | pivot tube |
| 80 | bracket |
| 82 | bracket |
| 82a | bracket |
| 84 | inwardly facing edge |
| 86 | top edge |
| 88 | mounting hole |
| 90 | pivot mount |
| 90a | pivot mount |
| 92 | pivot mount |
| 92a | pivot mount |
| 94 | pivot rod |
| 94a | pivot rod |
| 96 | seal flap |
| 96a | seal flap |
| 98 | loose media |
| 100 | precompressed media |
| 102 | additional loose media |
| 104 | bale |

It is claimed:

1. A loose media compacting system comprising:

a. a charging chamber with retractable walls, the charging chamber mounted to and aligned along and about a framework, the framework including a hydraulic power means, a main hydraulic actuating cylinder, a compression ram connected to and positionable by the main hydraulic actuating cylinder along a lower guide plate, the charging chamber having variable geometry, wherein the retractable walls of the charging chamber are actuatable and forcibly pivotable opposed rear and front retractable charging chamber walls, each of the retractable charging chamber walls is pivotably mounted to a pivot mount adjacent the lower guide plate, the retractable charging chamber walls of the charging chamber have media contact surfaces that are vertical in a closed and compacted condition of the charging chamber and inclined in an open and expanded condition of the charging chamber, the media contact surfaces of the retractable walls of the charging chamber contact and transform loose media to a precompressed condition as they forcibly pivot to vertical in the closed and compacted condition, each of the actuatable and forcibly pivotable opposed retractable charging chamber walls having a side plate intersecting a top plate, an arcuate top cover plate, and a serrated knife at an inner edge of the top plate, the side plate having the media contact surface, the side plate intersecting and securing to the top plate in perpendicular fashion and delineates a division of the top plate into an outwardly directed top plate section and an inwardly directed top plate section, and the arcuate top cover plate is positioned above the top plate; and, b. a loading chamber having straight and vertically aligned walls aligned above the charging chamber having variable geometry.

2. A loose media compacting apparatus comprising:

a. a variable geometry charging chamber characterized by capability to change between a closed and compact position and an open and expanded position, the variable geometry charging chamber including actuatable and forcibly pivotable opposed rear and front retractable charging chamber walls, each of the retractable charging chamber walls is pivotably mounted to a pivot mount adjacent a lower guide plate portion of the charging chamber, the opposed rear and front charging chamber walls have media contact surfaces that are vertical when the variable geometry charging chamber is in the closed and compact position and the opposed rear and front walls contact and transform loose media to a precompressed condition as they forcibly pivot to vertical during actuation from the open and expanded position to the closed and compact position, each of the actuatable and forcibly pivotable opposed retractable charging chamber walls having a side plate intersecting a top plate, an arcuate top cover plate, and a serrated knife at an inner edge of the top plate, the side plate having the media contact surface, the side plate intersecting and securing to the top plate in perpendicular fashion and delineates a division of the top plate into an outwardly directed top plate section and an inwardly directed top plate section, and the arcuate top cover plate is positioned above the top plate; and, b. a compression ram capable of traveling through the variable geometry charging chamber in the closed and compact position.

3. The loose media compacting apparatus of claim 2, further comprising:

c. a loading chamber aligned above the variable geometry charging chamber; and, d. a compression chamber situated horizontally adjacent the variable geometry charging chamber.

4. The loose media compacting apparatus of claim 3, wherein the compression ram travels through the compression chamber subsequent to traveling through the variable geometry charging chamber in the closed and compact position.

5. The loose media compacting apparatus of claim 2, wherein the pair of opposed pivotably retractable walls are driven hydraulically about pivots mounted to a framework juxtaposing an interspersed portion of the lower guide plate portion of the variable geometry charging chamber.

6. The loose media compacting apparatus of claim 3, wherein each of the arcuate cover plates forms a barrier interposable between the loading chamber and the variable geometry charging chamber, the barrier restricts full and direct communication between the loading chamber and the variable geometry charging chamber when the wall is vertically positioned and the variable geometry charging chamber is in the closed and compact position.

7. The loose media compacting apparatus of claim 6, wherein the barrier terminates in the serrated knife.

8. The loose media compacting apparatus of claim 7, wherein the barrier is one of a pair of opposed barriers, each of the barriers carried by the opposed pivotably retractable wall, such that the serrated knife cuts, tears, or holds any loose media extending upward from the variable geometry charging chamber when the pivotably retractable walls are moved to vertical.

9. The loose media compacting apparatus of claim 8, wherein the barriers are arcuate in shape.

10. The loose media compacting apparatus of claim 9, wherein the compression ram includes a shear knife, the shear knife is situated and travels immediately beneath the serrated knives when the compression ram travels through the closed and compacted variable geometry charging chamber.

11. A process for charging a loose media baler comprising the steps of:

a. providing a variable geometry charging chamber horizontally adjacent a compression chamber of the loose media baler, the variable geometry charging chamber aligned below a loading chamber and having a compression ram for urging precompressed loose media from the variable geometry charging chamber into the compression chamber, the variable geometry charging chamber having a pair of opposed pivotably retractable walls, each of the retractable walls is pivotably mounted to a pivot mount adjacent a lower guide plate portion of the charging chamber, each having a barrier for at least partially restricting communications between the loading chamber and the variable geometry charging chamber, the walls of the pair of opposed pivotably retractable walls, each having a media contact surface that is vertical when the variable geometry charging chamber is in a closed and compacted condition, each of the retractable walls having a side plate, a top plate, an arcuate top cover plate, and a serrated knife at an inner edge of the top plate, the side plate having the media contact surface, the side plate intersecting and securing to the top plate in perpendicular fashion and delineates a division of the top plate into an outwardly directed top plate section and an inwardly directed top plate section, and the arcuate top cover plate is positioned above the top plate;

b. retracting the pair of opposed pivotably retractable walls to place the variable geometry charging chamber in an open and expanded position and allow communication with the loading chamber;

c. allowing gravitational transfer of loose media from the loading chamber into the variable geometry charging chamber;

d. actuating the pair of opposed pivotably retractable walls such that the media contact surfaces are in a vertical position thereby placing the variable geometry charging chamber in a closed and compacted position and restricting communication with the loading chamber and precompressing loose media situated within the variable geometry charging chamber between the pair of opposed pivotably retractable walls due to transforming contact with the media contact surfaces of the pair of opposed pivotably retractable walls as the pair of media contact surfaces of the opposed pivotably retractable walls become vertical; and, e. expelling the precompressed media from the variable geometry charging chamber into the compression chamber with the compression ram.

12. The process of claim 11, further comprising the steps of:

f. retracting the compression ram; and, g. repeating steps b through e.

13. The process of claim 11, wherein the pair of opposed pivotably retractable walls are actuated simultaneously.

14. The process of claim 11, wherein the barrier has the serrated knife situated to cut, tear, or hold loose media extending between the variable geometry charging chamber and the loading chamber during actuation of the pivotably retractable wall.

15. The process of claim 11, wherein the steps of retracting and actuating are hydraulically driven.

16. The process of claim 12, wherein the steps of retracting the compression ram and expelling the precompressed loose media are hydraulically driven.

17. The process of claim 12, wherein the loading chamber is continuously loaded with loose media.

18. A loose media compacting apparatus comprising:

a. a framework having support feet, protective panels, a hydraulic power center and an electrical control panel, a main hydraulic actuating cylinder having a stationary end secured to the framework and a positionable end secured to a compression ram with a shear knife located at an upper leading edge of the compression ram, a substantial lower guide plate for guiding the compression ram during travel of the compression ram;

b. a compression chamber at an end of the guide plate opposite the stationary end of the main hydraulic actuating cylinder and aligned to accommodate the compression ram during travel of the compression ram;

c. a charging chamber adjacent and integrally attached to the compression chamber for passage of the compression ram, wherein the charging chamber includes pivotably retractable front and rear walls with media contact surfaces contacting and transforming loose media into precompressed media, each of the front and rear walls is pivotably mounted to a pivot mount adjacent a lower guide plate portion of the charging chamber, the media contact surfaces of the pivotably retractable front and rear walls are vertically oriented in a closed and compact condition of the charging chamber and outwardly inclined in an open and expanded condition of the charging chamber thereby providing variable geometry to the charging chamber, each of the front and rear walls having a side plate, a top plate, an arcuate top cover plate, and a serrated knife at an inner edge of the top plate, the side plate having the media contact surface, the side plate intersecting and securing to the top plate in perpendicular fashion and delineates a division of the top plate into an outwardly directed top plate section and an inwardly directed top plate section, and the arcuate top cover plate is positioned above the top plate.

19. The loose media compacting apparatus of claim 18, further comprising:

d. a loading chamber aligned above the charging chamber.

20. The loose media compacting apparatus of claim 18, wherein the compression ram travels through the compression chamber subsequent to traveling through the charging chamber in the closed and compact position.

21. The loose media compacting apparatus of claim 19, wherein the pivotable walls of the charging chamber may be moved independently of each other.

22. The loose media compacting apparatus of claim 21, wherein the pair of opposed pivotably retractable walls are driven hydraulically about pivots mounted to a framework juxtaposing an interspersed portion of the guide plate of the apparatus.

23. The loose media compacting apparatus of claim 19, wherein each of the arcuate top cover plates formed a barrier interposable between the loading chamber and the charging chamber, which barrier prevents full and direct communication between the loading chamber and the charging chamber when the retractable walls are vertically positioned and the charging chamber is in the closed and compact position.

24. The loose media compacting apparatus of claim 23, wherein the barriers each terminate in the serrated knife.

25. The loose media compacting apparatus of claim 23, wherein the barriers are arcuate in shape.

26. The loose media compacting apparatus of claim 24, wherein the shear knife located on the compression ram is situated and travels immediately beneath the serrated knives when the compression ram travels through the charging chamber.

* * * * *